US006652230B1

(12) United States Patent
Huang et al.

(10) Patent No.: US 6,652,230 B1
(45) Date of Patent: Nov. 25, 2003

(54) SERIAL FAN WITH A PLURALITY OF ROTOR VANES

(75) Inventors: Wen-shi Huang, Taoyan (TW); Kuo-cheng Lin, Taoyan (TW); Shun-chen Chang, Taoyan (TW)

(73) Assignee: Delta Electronics, Inc., Taoyan Shien (TW)

( * ) Notice: Subject to any disclaimer, the term of this patent is extended or adjusted under 35 U.S.C. 154(b) by 0 days.

(21) Appl. No.: 09/484,497

(22) Filed: Jan. 18, 2000

(30) Foreign Application Priority Data

Nov. 25, 1999 (TW) ..... 88220261 U

(51) Int. Cl.[7] ..... F04D 29/44
(52) U.S. Cl. ..... 415/198.01; 415/193
(58) Field of Search ..... 415/198.1, 193, 415/194, 195, 119, 97; 416/128

(56) References Cited

U.S. PATENT DOCUMENTS 1,985,022 A * 12/1934 De Bothezat ..... 416/129
2,121,073 A * 6/1938 De Bothezat ..... 416/129
2,313,413 A * 3/1943 Weske ..... 416/129
3,270,820 A * 9/1966 Frazier ..... 416/129

* cited by examiner

*Primary Examiner*—John Kwon
(74) *Attorney, Agent, or Firm*—Birch, Stewart, Kolasch & Birch, LLP

(57) ABSTRACT

An axial flow serial fan includes a single frame, a first rotor vane having at least one first blades; and a second rotor vane having at least one second blades, wherein the first rotor vane and the second rotor vane are provided in series in the single frame along an axial direction to minimize space occupied by the axial-flow serial fan in the axial direction.

1 Claim, 3 Drawing Sheets

SERIAL FAN WITH A PLURALITY OF ROTOR VANES

BACKGROUND OF THE INVENTION

1. Field of the Invention

The present invention relates to an axial-flow fan and, more particularly, to an axial-flow fan that connects a plurality of rotor vanes in series in a single fan.

2. Description of the Related Art

The axial-flow fan is a popular fan device that has the features such as a simple structure, low cost, and a high air flow rate. These features have made it widely used in various systems as an air conditioning or ventilating device, for example, as the ventilation fan in a computer system.

In general, since the total pressure of the axial-flow fan is lower, the axial-flow fan cannot fully develop a high flow rate in a system of a high resistance. Therefore, in the case that a high total pressure is needed, two or more axial-flow fans are conventionally employed in series to provide the high total pressure.

Moreover, to avoid the interruption of operation due to the breakdown of the fans, a set of standby fan system is usually provided in series to the original fan system to avoid the system or device damage due to the interruption of the fan operation.

However, connecting two fans in series does not double the total pressure. Even if only one fan operates and the other stays still as a standby fan, the latter one reduces the total pressure of the fan in operation. The reason is that when the two fans are connected in series, the resistance between them increases and the operation efficiencies of them is decreased. Thus, in certain situations, for example in an air duct of an air conditioning system, the two axial-flow fans in series are separated far apart to minimize the interference between them. Nevertheless, this method is not feasible in the case that the installation space is limited.

Therefore, how to design an axial-flow serial fan with a plurality of rotor vanes that requires a small space and has the least interference effect becomes an important subject.

SUMMARY OF THE INVENTION

In view of the foregoing problems, an object of this invention is to provide an axial-flow serial fan with a plurality of rotor vanes, which reduces the air flow interference between the rotor vanes so that the total pressure of the serial fan with a plurality of rotor vanes can be increased.

Another object of the invention is to provide an axial-flow serial fan with a plurality of rotor vanes that occupies less space in its axial direction.

To achieve the above objects, an axial-flow serial fan comprises a single frame, a first rotor vane having at least one first blades; and a second rotor vane having at least one second blades, wherein the first rotor vane and the second rotor vane are provided in series in the single frame along an axial direction to minimize space occupied by the axial-flow serial fan in the axial direction.

According to the present invention, the design of each of the rotor vanes takes into account the air flow interference. The shape of the blade of each of the rotor vanes thus designed can improve the total pressure of the plurality of rotor vanes connected in series.

According to the present invention, since the plurality of rotor vanes are installed within a signal frame and the span between any two adjacent rotor vanes is minimized, therefore the volume of the fan in the axial direction can be greatly reduce.

Since the air flow is guided by directly using the relationship between the rotor vanes in accordance with the invention, there is no need to install extra elements for guiding air and the manufacturing cost and installation cost can be lowered.

Since there are a plurality of rotor vanes within a signal frame in accordance with the invention, some of the rotor vanes can be used as standby rotor vanes without affecting the total pressure of the active rotor vanes in operation.

Further scope of the applicability of the present invention will become apparent from the detailed description given hereinafter. However, it should be understood that the detailed description and specific examples, while indicating preferred embodiments of the invention, are given by way of illustration only, since various changes and modifications within the spirit and scope of the invention will become apparent to those skilled in the art from this detailed description.

BRIEF DESCRIPTION OF THE DRAWINGS

The present invention will become more fully understood from the detailed description given hereinbelow, wherein.

DETAILED DESCRIPTION OF THE INVENTION

An axial-flow serial fan with a plurality of rotor vanes in accordance with a preferred embodiment of the invention is hereinafter explained with reference to the accompanying drawings, wherein the same devices are represented by the same numbers.

Figure 1:
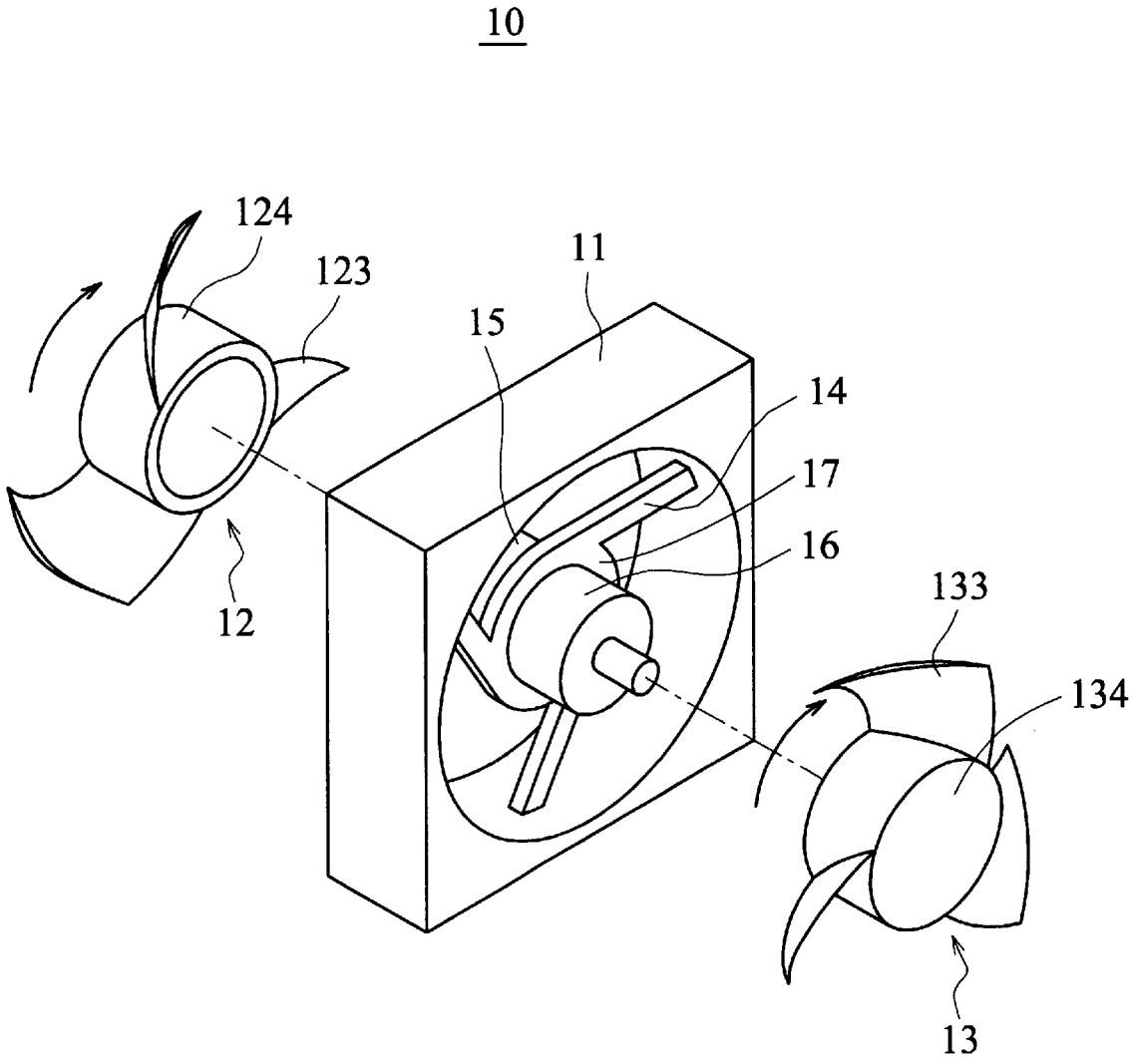
FIG. 1 is a three-dimensional view of an axial-flow serial fan in accordance with a preferred embodiment of the invention.

FIG. 1 is a three-dimensional view of an axial-flow serial fan 10 in accordance with a preferred embodiment of the invention. The axial-flow serial fan 10 comprises a single frame 11, a first rotor vane 12, and a second rotor vane 13. The first rotor vane 12 is installed on the inlet side of the axial-flow serial fan 10 and contains a second hub 134 and three second blades 133. The first rotor vane 12 and the second rotor vane 13 are provided in series in the single frame along the axial direction. A support 17 is provided inside the single frame 11 with a plurality of ribs 14 connecting the support 17 to the frame 11. A first motor is provided on the inlet side of the support 17 and within the first hub 124 for driving the first rotor vane 12; and a second motor 18 is provided on the outlet side of the support 17 and within the second hub 134 for driving the second rotor vane 13.

Figure 2:
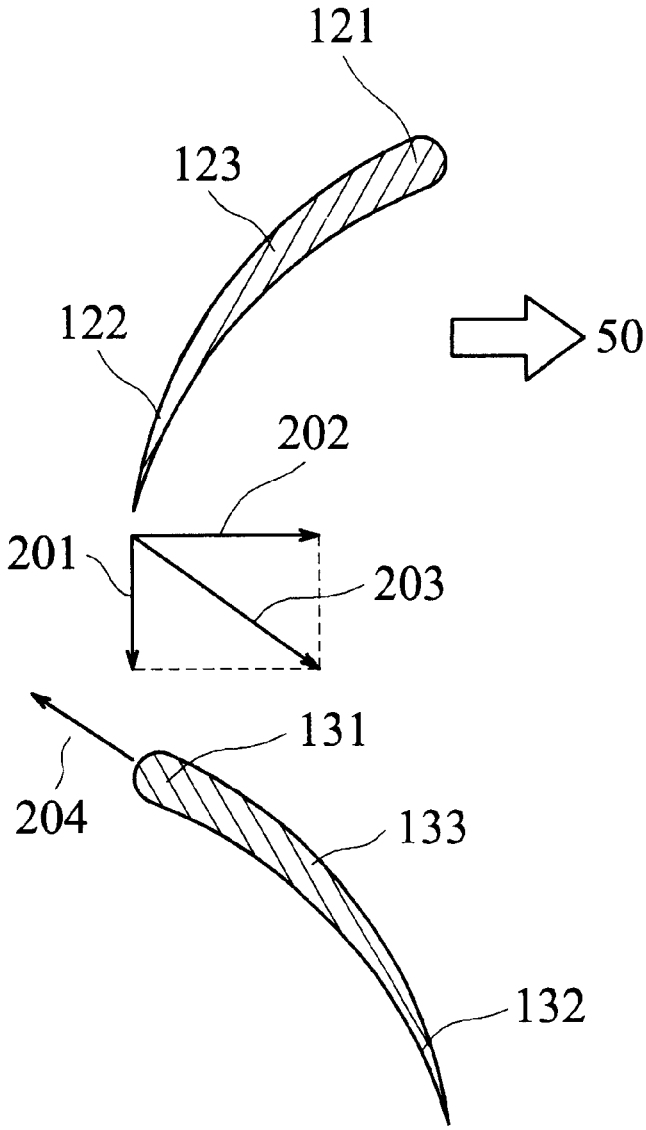
FIG. 2 is a schematic view of the relative rotation relation between the first and second blades in an axial-flow serial fan in accordance with the preferred embodiment of the invention.

FIG. 2 is a schematic view of the relative rotation relation between said first blade 123 of said first rotor vane 12 and said second blade 133 of said second rotor vane 13. The symbols 121 and 122 represent the inlet and outlet sides of said first blade 123 respectively. The symbol 131 is the inlet side of said second blade 133. Referring to FIG. 2, if said second rotor vane 13 is set as a standby rotor vane, then only said first rotor vane 12 is rotating and said second rotor vane 13 stays still when said fan 10 is in normal operation. At this moment, if said first blade 123 rotates in the direction indicated by an arrow 50, then air flows out of said outlet side 122 of said first blade 123 along its shape after shearing by the inlet side of said first blade 123. In FIG. 2, the vector 201 indicates the magnitude and direction of the air flow velocity relative to the outlet side 122 of said first blade 123. However, due to the rotation of said first blade 123 itself, the air flow velocity from the outlet side 122 of said first blade 123 relative to said second blade 133 equals to the sum of the velocity vector 202 of the outlet side 122 of said first blade 123 and the vector 201. A vector 204 indicates the extension direction of the inlet side 131 of said second blade 133. Obviously, if the air flow vector 203 out of said first blade 123 is parallel to the vector 204, then the air flow experiences the least resistance and the interference between the rotor vanes also minimizes. In fact, said standby second blade 133 in this situation has a similar function to that of a conventional air guiding vane, which does not interfere the air flow and even corrects the outgoing direction of the air flow so as to increase the flow rate and pressure.

Said first rotor vane 12 and said rotor vane 13 can rotate at the same time. One can design the shapes of said first blade 123 and said second blade 133 according to the rotation and wind speeds needed so that the air flow out of said first blade 123 can be parallel to the extension direction of the inlet side 131 of said second blade 133. In general, it is preferable to have said first rotor vane 12 and said second rotor vane 13 rotate in opposite directions with respect to the orientations of said first blade 123 and said second blade 133 as shown in FIG. 2. Only in this way, when said first rotor vane 12 and said second rotor vane 13 rotate at the same time, they can guide the air flow and do not lower the pressure due to the interference with each other in this serial fan.

As a matter of fact, it is possible that even if the shape of the fan is so designed that the outgoing direction of the air flow from said first blade 123 is parallel to the extension direction on the inlet side 131 of said second blade 133, the desirable effects still cannot be achieved in real operation because of the environmental changes or other factors such as design or manufacture errors. Nevertheless, as long as the outgoing direction of the air flow from said first blade 123 is not much different from the extension direction on the inlet side 131 of said second blade 133, the basic feature of this invention can be maintained and the function of flow guidance can be achieved. As the two directions more and more deviate from each other, the design of rotor vanes in series is then far from the spirit of the instant invention and the air flow interference becomes more and more serious.

Moreover, in this embodiment it is necessary for said second driving motor 16 to be installed on said support 17. An axis can be connected to said second rotor vane 13 so that said second rotor vane 13 can rotate freely with respect to said support 17. Said second rotor vane 13 would not be driven to rotate and only possesses the function of guiding the outlet airflow. Similarly, through the design of the blade shape, said first driving motor 15 can be saved so that said first rotor vane 12 can only have the function of guiding inlet air flow.

Since the two rotor vanes are provided with a single frame without extra guiding devices and the span between the two rotor vanes can be minimized, the serial fan with a plurality of rotor vanes of the invention occupies the least space in the axial direction. This feature is very important for systems such as a server or a notebook that requires a fan having a high flow rate or pressure but having a small space for the fan.

Figure 3:
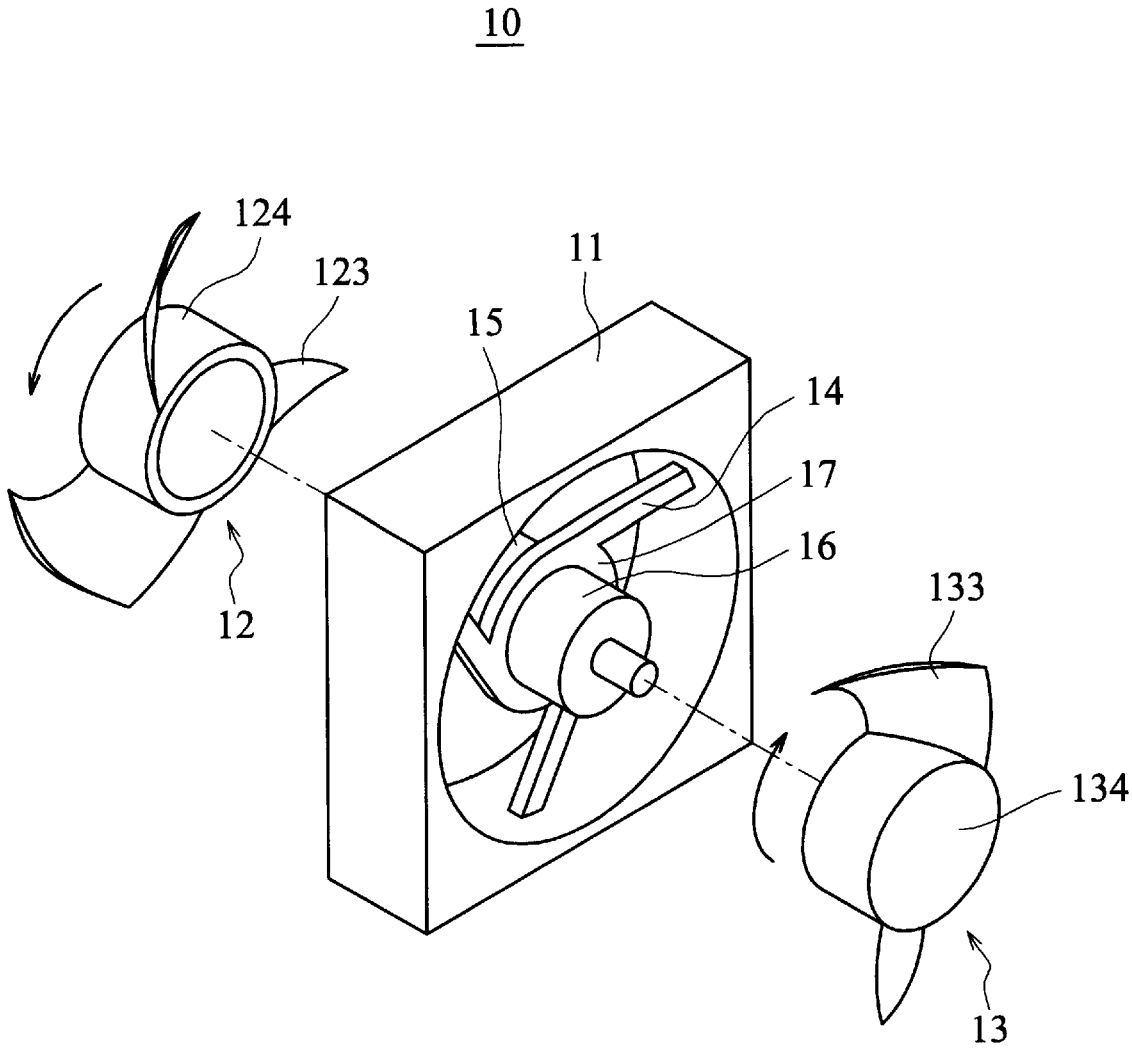
FIG. 3 is a three-dimensional view of an axial-flow serial fan in accordance with a second preferred embodiment of the invention.

The numbers of first and second blades both are three in accordance with the embodiment. However, the numbers of first and second blades may be different, for example, three first blades and two second blades as shown in FIG. 3. Also, the shape of the blades, the tilting angles of the blades, the rotation direction, and the rotation speed can vary. Therefore, by designing different rotation states of both rotor vanes, one can achieve the rotational balance of the fan and can reduce the vibration and noise in rotation. Furthermore, through the design of how both rotor vanes are installed, the two rotor vanes can share a single driving motor to lower the manufacturing cost and the assembling cost.

Aside from the previous embodiment, the invention can be implemented in other ways. For example, three or more rotor vanes can be serially connected to increase the total pressure or air flow rate of the fan. The positions of the rotor vanes are not limited to the opposite sides of the support and can be disposed on the same side if necessary. The inlet and outlet sides of the fan can be provided with ribs and the rotor vanes are protected within the fan frame. The shape of the ribs is not limited to the long-beam shape, and can be any shape that reduces the air flow pressure so as to enhance the efficiency.

While the invention has been described by way of example and in terms of a preferred embodiment, it is to be understood that the invention is not limited to the disclosed embodiment. To the contrary, it is intended to cover various modifications. Therefore, the scope of the appended claims should be accorded the broadest interpretation so as to encompass all such modifications.

What is claimed is:

1. An axial-flow serial fan, comprising:

a single frame;

a first rotor vane having at least one first blades; and a second rotor vane having at least one second blades, wherein the first rotor vane and the second rotor vane are provided in series in the single frame along an axial direction, and the first rotor vane and the second rotor vane are close enough such that an incoming airflow to the second rotor vane has a velocity vector equal to the velocity vector of airflow relative to one of the first blades on an outlet side of the first rotor vane) plus (the velocity vector of the second blades relative to the first blades).

* * * * *